US011892231B2

(12) United States Patent
Pasham et al.

(10) Patent No.: US 11,892,231 B2
(45) Date of Patent: Feb. 6, 2024

(54) REFRIGERATOR DEAD SPACE STORAGE SYSTEMS

(71) Applicant: Haier US Appliance Solutions, Inc., Wilmington, DE (US)

(72) Inventors: Srinivas Pasham, Hyderabad (IN); Rukmini Harika Relangi, Hyderabad (IN); Soumya Bhardwaj, Jabalpur (IN); Rafi Shaik Mahammed, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 109 days.

(21) Appl. No.: 17/351,573

(22) Filed: Jun. 18, 2021

(65) Prior Publication Data

US 2022/0404092 A1 Dec. 22, 2022

(51) Int. Cl.
*F25D 25/02* (2006.01)

(52) U.S. Cl.
CPC ..... *F25D 25/027* (2013.01); *F25D 25/024* (2013.01); *F25D 25/022* (2013.01); *F25D 25/025* (2013.01); *F25D 2325/021* (2013.01)

(58) Field of Classification Search
CPC .... F25D 25/027; F25D 25/022; F25D 25/025; F25D 2325/021; F25D 25/024; A47B 96/025; A47B 96/061; A47B 96/067
See application file for complete search history.

(56) References Cited

U.S. PATENT DOCUMENTS

| | | | | |
|---|---|---|---|---|
| 2,658,811 | A * | 11/1953 | Eck | F25D 25/027 211/90.01 |
| 3,595,404 | A | 7/1971 | Goldstein | |
| 5,813,741 | A * | 9/1998 | Fish | F25D 25/024 312/351 |
| 7,469,980 | B2 | 12/2008 | Koo | |
| 8,182,056 | B2 * | 5/2012 | Gossens | A47B 88/483 312/408 |
| 8,444,239 | B2 * | 5/2013 | Gossens | F25D 25/024 312/408 |
| 9,127,878 | B2 | 9/2015 | Gossens | |
| 9,803,915 | B2 * | 10/2017 | Park | F25D 25/024 |
| 9,823,012 | B2 * | 11/2017 | Wantland | F25D 25/027 |
| 9,874,393 | B2 | 1/2018 | Andrew | |
| 10,151,526 | B1 * | 12/2018 | Pathapati | F25D 25/005 |
| 10,495,376 | B2 * | 12/2019 | Roesch | F25D 25/027 |
| 10,648,726 | B2 * | 5/2020 | Im | F25D 25/027 |

(Continued)

FOREIGN PATENT DOCUMENTS

KR 464312 Y1 12/2012

*Primary Examiner* — Kimberley S Wright
(74) *Attorney, Agent, or Firm* — Dority & Manning, P.A.

(57) ABSTRACT

Storage systems for use in consumer appliances are provided. Storage system can be a storage assembly defining a vertical direction, a lateral direction, and a transverse direction, the vertical, lateral, and transverse directions being mutually perpendicular. The storage assembly includes a mounting bracket, a first mounting tab and a second mounting tab extending in the transverse direction from a first end of the mounting bracket. The first mounting tab and the second mounting tab are configured to be inserted into a mounting track disposed within the consumer appliance. The storage assembly also includes a storage receptacle which is supported at a second end of the mounting bracket.

12 Claims, 12 Drawing Sheets

(56) References Cited

U.S. PATENT DOCUMENTS

| | | | | |
|---|---|---|---|---|
| 10,690,402 | B2 * | 6/2020 | Roesch | F25D 25/027 |
| 2009/0058248 | A1 * | 3/2009 | Gossens | A47B 96/061 211/90.02 |
| 2012/0211620 | A1 * | 8/2012 | Gossens | A47B 96/061 248/241 |
| 2016/0331129 | A1 * | 11/2016 | VanHeusden | A47B 97/00 |
| 2017/0276424 | A1 * | 9/2017 | Wantland | F25D 23/04 |
| 2018/0087828 | A1 * | 3/2018 | Park | F25D 25/02 |
| 2018/0335249 | A1 * | 11/2018 | Pathapati | A47B 88/40 |
| 2019/0056170 | A1 * | 2/2019 | Im | F25D 23/067 |

* cited by examiner

1518

REFRIGERATOR DEAD SPACE STORAGE SYSTEMS

FIELD

The present disclosure relates generally to storage systems and more particularly to storage systems for use in refrigerator appliances.

BACKGROUND

Consumer appliances, such as refrigerator appliances, generally include a cabinet that defines one or more internal chambers. In the case of refrigerator appliances, a chilled chamber may be defined for receipt of food items for storage. Consumer appliances can also include various storage components within the one or more internal chambers. For example, refrigerator appliances can include various storage components within the chilled chamber, which are designed to facilitate storage of food items. Such storage components can include racks, bins, shelves, or drawers that receive food items and assist with organizing and arranging food items within the chilled chamber.

Some existing refrigerator appliances include one or more shelves for holding or supporting food items within the chilled chamber. However, existing approaches for refrigerator shelving presents certain challenges, including the use of structural brackets to support shelves which consume and reduce storage space within refrigerator. For instance, existing brackets extend below the shelves and limit the vertical height available between shelves for storage. Additionally, existing approaches for refrigerator shelving involve storage shelves with frames and other structural components which prohibit storage of food items thereon and thus reduce the usable interior storage volume of a refrigerator appliance.

Accordingly, an appliance with a storage system that addresses one or more of the challenges noted above or which provide additional storage configurations and versatility would be useful and welcomed.

BRIEF DESCRIPTION

Aspects and advantages of embodiments of the present disclosure will be set forth in part in the following description, or may be learned from the description, or may be learned through practice of the embodiments.

One example aspect of the present disclosure a storage assembly for an appliance, the storage assembly defining a vertical direction, a lateral direction, and a transverse direction, the vertical, lateral, and transverse directions being mutually perpendicular. The storage assembly includes a mounting bracket, a first mounting tab and a second mounting tab extending in the transverse direction from a first end of the mounting bracket. The first mounting tab and the second mounting tab are configured to be inserted into a mounting track disposed within the consumer appliance. The storage assembly also includes a storage receptacle which is supported at a second end of the mounting bracket.

According to another exemplary embodiment, a storage assembly can define a vertical direction, a lateral direction, and a transverse direction, the vertical, lateral, and transverse directions being mutually perpendicular. The storage assembly can include a first mounting track with a guide surface and a cavity frame including a bottom portion. The bottom portion is attached between a rear plate and a front portion in the transverse direction and said bottom portion has a downward slope toward rear plate. The cavity frame defines a recess configured to accept the guide surface therein, and the mounting track is configured to be affixed to an appliance such that mounting track has a downward a rear wall of the appliance.

Variations and modifications can be made to these example aspects of the present disclosure. These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
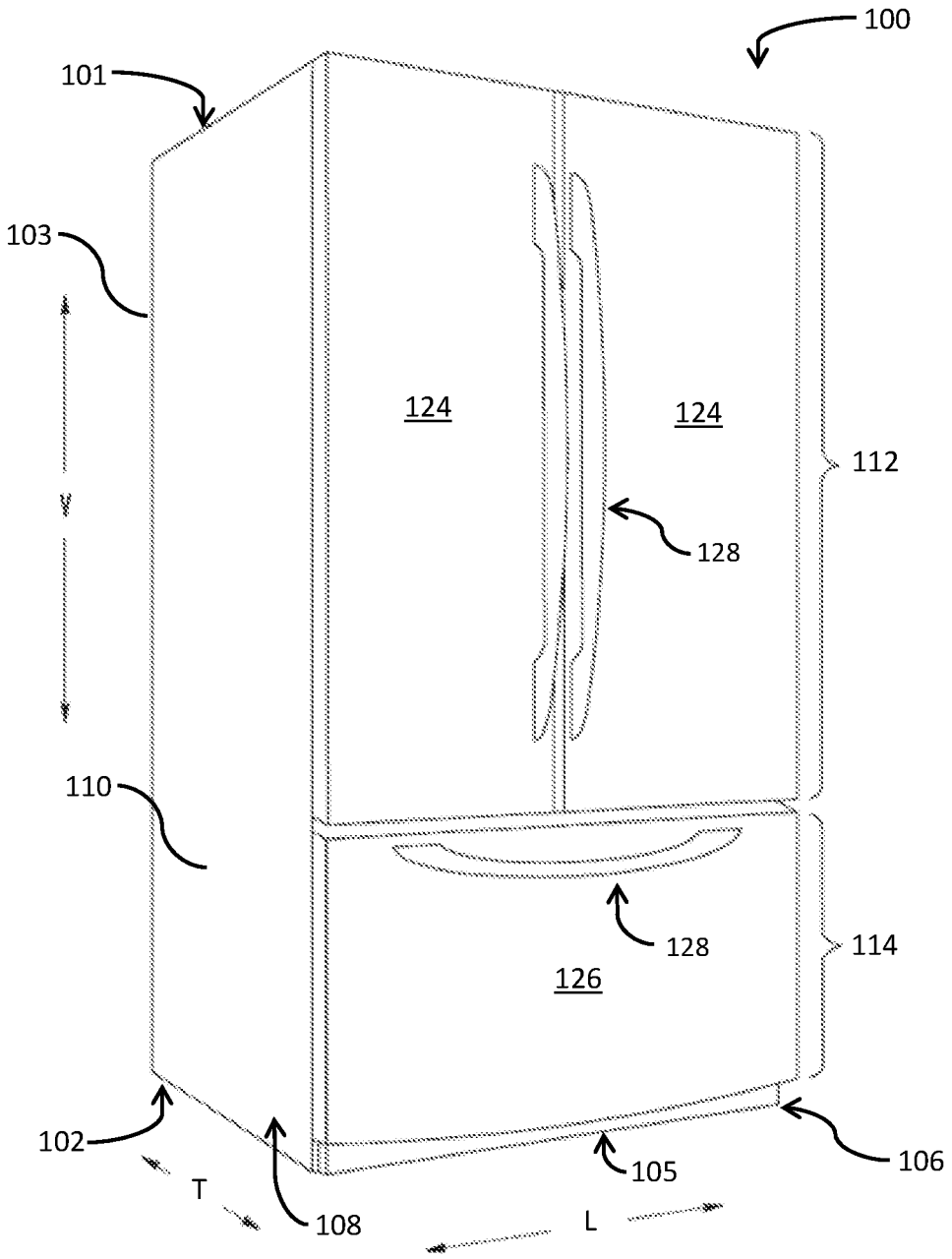
FIG. 1 depicts a front perspective view of a refrigerator appliance according to exemplary embodiments of the present disclosure.

Repeat use of reference characters in the present specification and drawings is intended to represent the same or analogous features or elements of the present disclosure.

DETAILED DESCRIPTION

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

As used herein, terms of approximation, such as "approximately," "substantially," or "about," refer to being within a ten percent margin of error.

Referring now to the figures, example aspects of the present disclosure will be discussed in greater detail.

FIG. 1 provides a perspective view of a refrigerator appliance 100 according to an exemplary embodiment of the present subject matter. Refrigerator appliance 100 defines a vertical direction V, a lateral direction L, and a transverse direction T. The vertical, lateral, and transverse directions V, L, and T are mutually perpendicular and form an orthogonal direction system.

Refrigerator appliance 100 includes a base cabinet or housing 110 that extends between a top portion 112 and a bottom portion 114 along the vertical direction V. Housing 110 defines a chilled chamber 120 for receipt of food items for storage. In particular, housing 110 defines chilled chamber 120 (shown in FIG. 2) positioned at or adjacent top portion 112 of housing 110 and a freezer chamber (not shown) arranged at or adjacent bottom portion 114 of housing 110. As such, refrigerator appliance 100 is generally referred to as a bottom mount refrigerator appliance or a bottom freezer refrigerator appliance. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Housing 110 also extends between a right side portion 106 and a left side portion 108, e.g., along the lateral direction L, forming a front portion 105. Housing 110 defines an opening 140 (shown in FIG. 2) for accessing fresh food chamber 120 (shown in FIG. 2) at or adjacent to front portion 105 of housing 110. Housing 110 also includes a back wall 103 extending between a bottom portion 102 and a top portion 101, e.g., along the vertical direction V. Housing 110 also includes a left side portion 108 and a right side portion 106, both of which extend between a front portion 105 and a back wall 103, e.g., along the transverse direction T.

Refrigerator doors 124 are rotatably mounted or hinged to an edge of housing 110, e.g., at front portion 105 of housing 110, for selectively accessing chilled chamber 120 (i.e., doors 124 are operably coupled to the cabinet/housing 110 to provide selective access to the chilled chamber 120). In addition, a freezer door 126 is arranged below refrigerator doors 124 for selectively accessing freezer chamber (not shown). Freezer door 126 is coupled to a freezer drawer (not shown) slidably mounted within freezer chamber (not shown). Refrigerator doors 124 are shown in an closed position and freezer door 126 are shown in a closed position in FIG. 1. When moved to an open position, refrigerator doors 124 permit access to chilled chamber 120 (shown in FIG. 2) through opening 140. Conversely, refrigerator doors 124 obstruct or limit access to chilled chamber 120 through opening 140 in the closed position in FIG. 1. Freezer door 126 operates similarly. Handles 128 can assist with operating refrigerator doors 124 and freezer door 126 between the open and closed positions.

Figure 2:
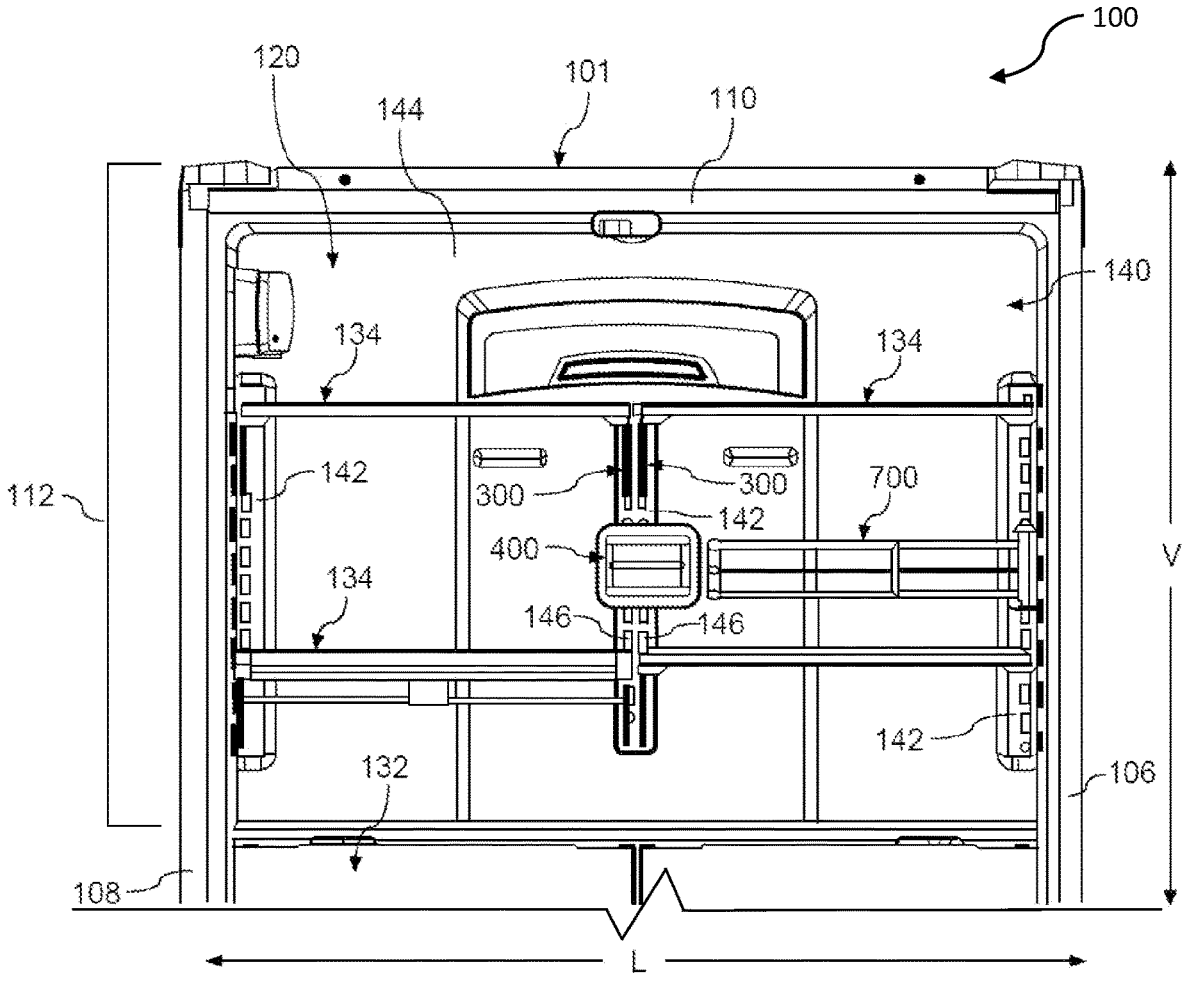
FIG. 2 depicts a front view of a portion of the top part of refrigerator appliance of FIG. 1 according to an exemplary embodiment of the present disclosure with doors of the refrigerator appliance removed to reveal exemplary dead space storage assemblies according to the present disclosure.

FIG. 2 depicts a front view of a partial refrigerator appliance, specifically the chilled chamber 120, according to an exemplary embodiment of the present disclosure with doors 124 of the refrigerator appliance removed to reveal certain components within chilled chamber 120 of the exemplary refrigerator appliance of FIG. 1.

Various storage components are mounted within chilled chamber 120 to facilitate storage of food items therein as will be understood by those skilled in the art. In particular, the storage components include bins (not shown), drawers 132, and shelves (e.g., a plurality of shelf 134) that are mounted within chilled chamber 120. Bins (not shown), drawers 132, and shelves (e.g., a plurality of shelf 134) are configured for receipt of food items (e.g., beverages and/or solid food items) and may assist with organizing such food items. As an example, drawers 132 can receive fresh food items (e.g., vegetables, fruits, and/or cheeses) and increase the useful life of such fresh food items.

Refrigerator 100 can also include one or more dead space shelf assemblies, such as fixed dead space storage assembly 400 and pivoting dead space shelf assembly 700. It should be appreciated that sliding dead space storage assembly 1100 and 1500 could also be situated within chilled chamber in locations where fixed dead space storage assembly 400 and pivoting dead space shelf assembly 700 are depicted in FIG. 2. Although the illustrated embodiment shows dead space shelf assemblies in certain locations within the chilled chamber 120, it should be appreciated that dead space shelf assemblies, such as fixed dead space storage assembly 400 and pivoting dead space shelf assembly 700, may be interchangeable within the chilled chamber 120 and can be positioned at mounting track 142 (e.g., "cant racks") affixed to a cabinet housing 110, or any other suitable mounting point or location within chilled chamber 120.

Figure 3:
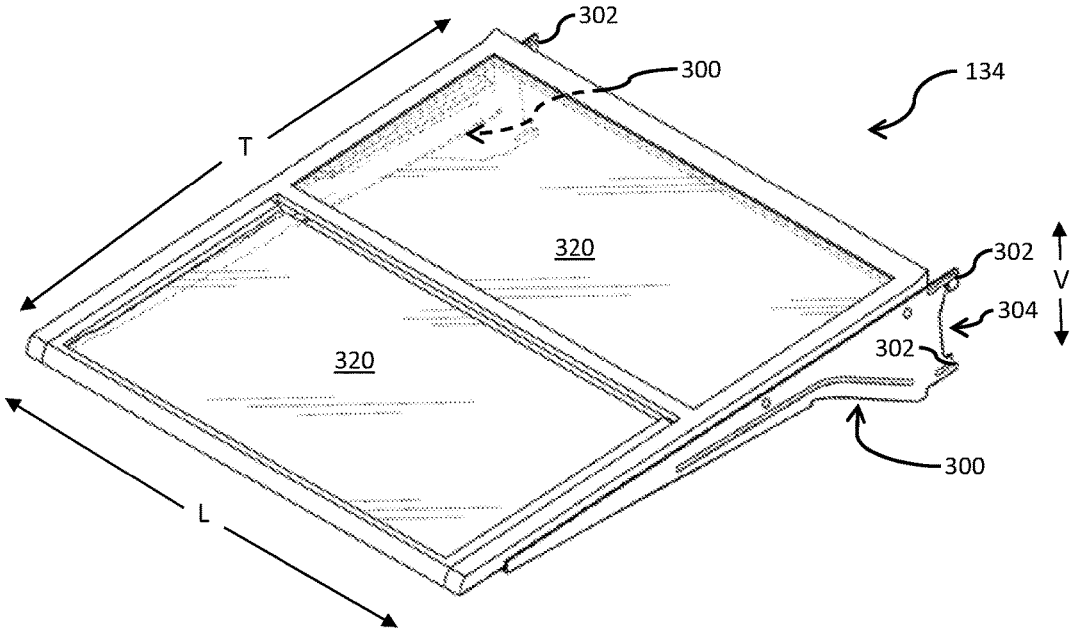
FIG. 3 depicts a perspective view of a shelf assembly which can be included in refrigerator appliance of FIGS. 1 and 2.

FIG. 3 depicts a perspective view of a shelf which can be included in refrigerator appliance of FIG. 1 for context. Shelf 134 includes a pair of side supports, such as brackets 300. Brackets 300 are spaced apart from each other, e.g., along the lateral direction L. One or more shelf plates 320 can be mounted to brackets 300. Thus, fixed shelf 134 extends between and connects brackets 300, e.g., along the lateral direction L. Shelf 134 can be positioned within the chilled chamber 120 at mounting track 142. More specifically mounting tabs 302 of mounting brackets 300 can be inserted into one or more of the plurality of slots 146 (shown in FIG. 2) of mounting track 142 to shelf 134. Brackets extend downward in a vertical direction V at rear of bracket 304. In this way, brackets 300 utilize and reduce storage space within chilled chamber 120 below brackets 300.

Figure 4:
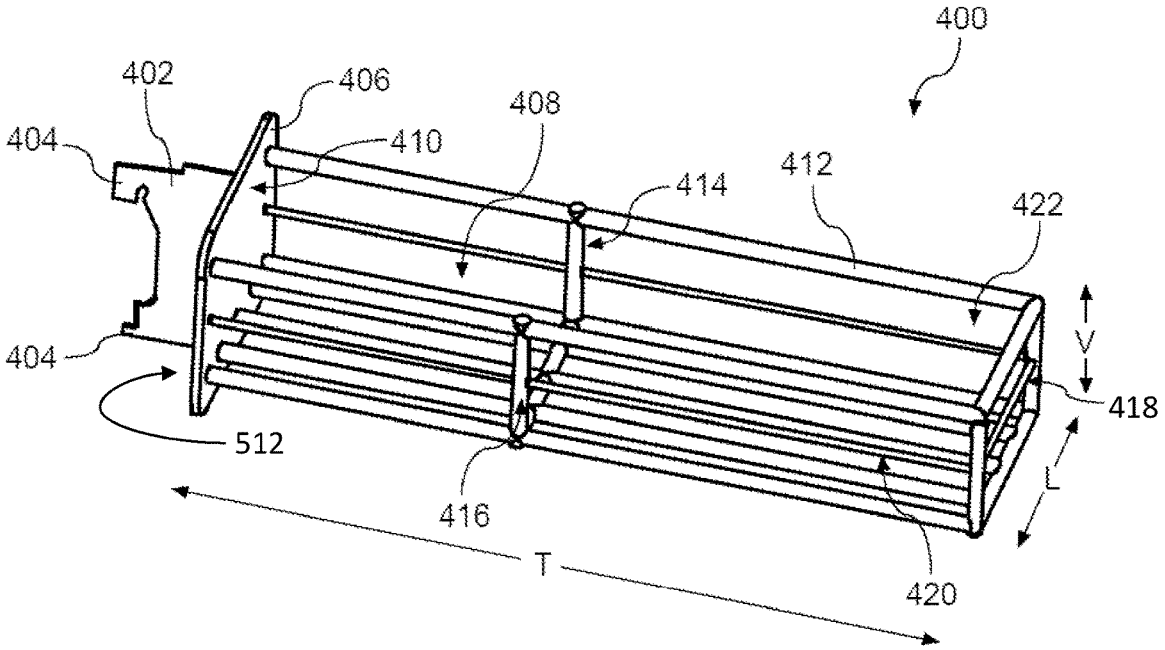
FIG. 4 depicts a perspective view of a fixed dead space storage assembly according to an exemplary embodiment of the present disclosure.

FIG. 4 depicts a perspective view of a fixed dead space storage assembly 400 according to an exemplary embodiment of the present subject matter. Fixed dead space storage assembly 400 is configured for use in many applications, including with any appliance such as a refrigerator appliance. As an example, fixed dead space storage assembly 400 may be positioned within chilled chamber 120 of refrigerator appliance 100 and utilized in any location along mounting track 142. Mounting tabs 404 of mounting bracket 402 can be inserted into mounting track 142 to support fixed dead space storage assembly 400. Fixed dead space storage assembly 400 can also include a rear plate 406. Rear plate 406 is attached to mounting bracket 402 such that rear plate 406 and mounting bracket 402 cannot move relative to one another (i.e., the mounting bracket 402 is attached to a rear surface 512 of the rear plate 406 such that mounting bracket 402 is immovable with respect to the rear surface 512. Rear plate 406 can be attached to mounting bracket 402 by known methods such as welding, screws, bolts, and/or clips. Mounting bracket 402 is preferably formed from metal, such as aluminum, but can be formed from plastic or another suitable material. Rear plate 406 can be formed from plastic, metal or another suitable material. In some embodiments mounting bracket 402 and rear plate 406 can be integrally formed as a single piece. Rear plate 406 forms a front surface 410 extending a lateral direction L and vertical direction V. Front surface 410 is formed in a plane that is perpendicular to the transverse direction T.

Fixed dead space storage assembly 400 can also include a cavity frame 412. The cavity frame 412 and rear plate 406 define form storage cavity or storage receptacle 408. While cavity frame 412 is depicted in FIGS. 4, 5, 7, 8 and 10 as a wire rack or wire tray, it should be appreciated that other configurations can be used for cavity frame 412, including a storage receptacle 408 with a solid bottom and solid sides (such as storage receptacle 1106 depicted in FIGS. 11, 12, 14, 15 and 18) made from a suitable material such as metal or plastic. Cavity frame 412 includes a front portion 418, a right-side portion 414, a left-side portion 416 and a bottom portion 420. Front portion 418 extends between a right-side portion 414 and a left-side portion 416 (e.g., along the lateral direction L), and front portion 418 extends in a vertical direction V from bottom portion 420. Cavity frame 412 and rear plate 406 define a storage receptacle 408 which if accessible through opening 422 which allows for storage of food or other items within storage receptacle 408. Opening 422 extends between front portion 418 and rear plate 406 in a transverse direction T and extends between right-side portion 414 and left side portion 416 in a lateral direction L. Opening 422 faces bottom portion 420 in a vertical direction V. Cavity frame 412 also includes a left-side portion 416 and a right-side portion 414, both of which extend between a front portion 418 and front surface 410 of rear plate 406, e.g., along the transverse direction T.

Bottom portion 420 can be angled downward in a vertical direction V as bottom portion 420 extends in a transverse direction T toward rear plate 406. In some other embodiments bottom portion 420 can be angled upward in a vertical direction V as bottom portion 420 extends in a transverse direction T toward rear plate 406. The downward (or upward) angle of the bottom portion 420 can be between 8 degrees and 12 degrees. In this way, food items placed within storage cavity 408 can slide along bottom portion 420 toward rear plate 406 (or in some embodiments toward front portion 418), improving the ease with which all of the capacity of storage cavity 408 can be efficiently used by a consumer. One of ordinary skill will appreciate that the slope of bottom portion 420 if storage receptacle 408 can also be found in the other exemplary embodiments of the present disclosure, such as those depicted in FIGS. 5, 7, 8, 10, 11, and 15.

Figure 5:
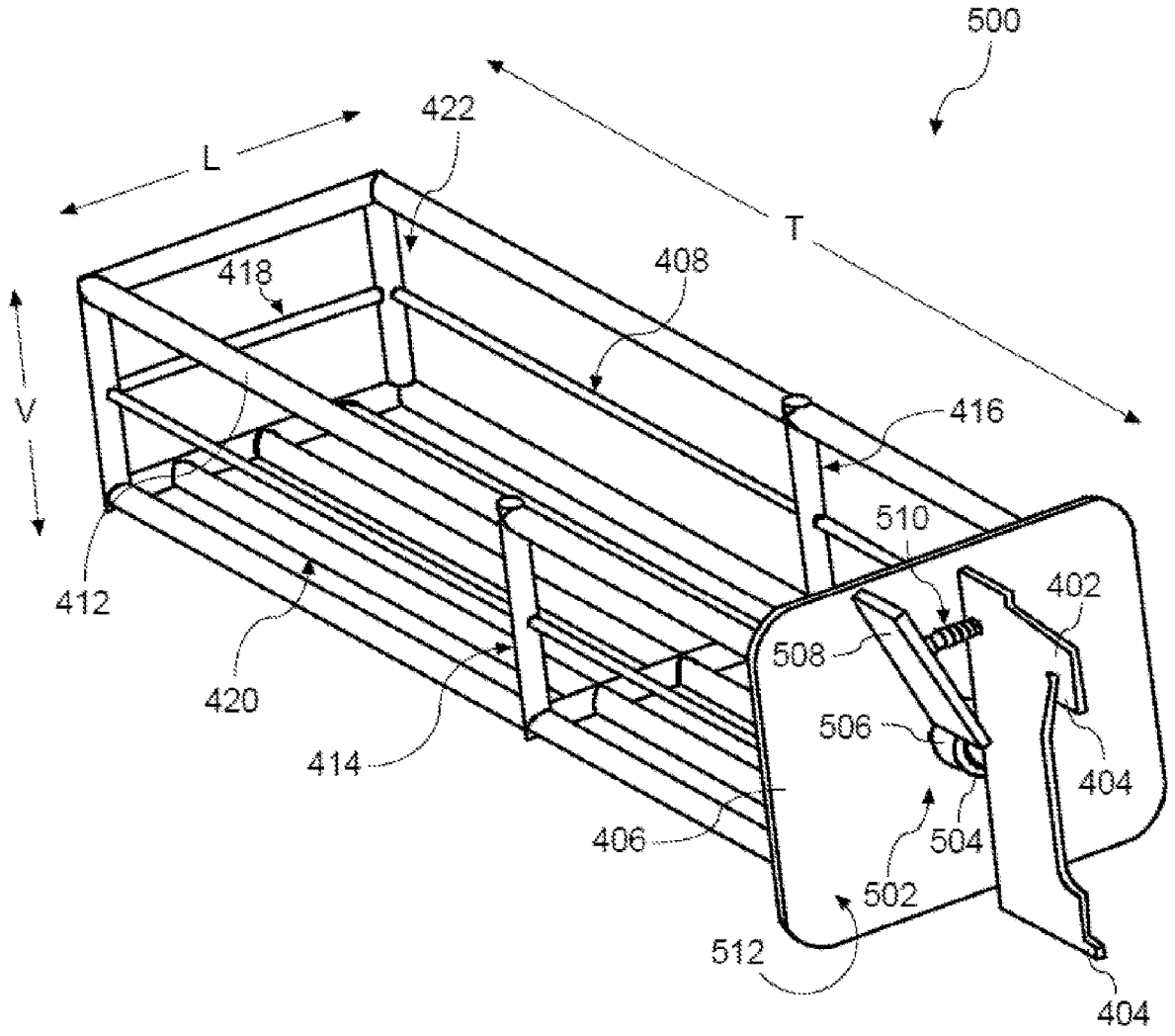
FIG. 5 depicts a rear perspective view of a tilting dead space storage assembly according to an exemplary embodiment of the present disclosure.
Figure 6A:
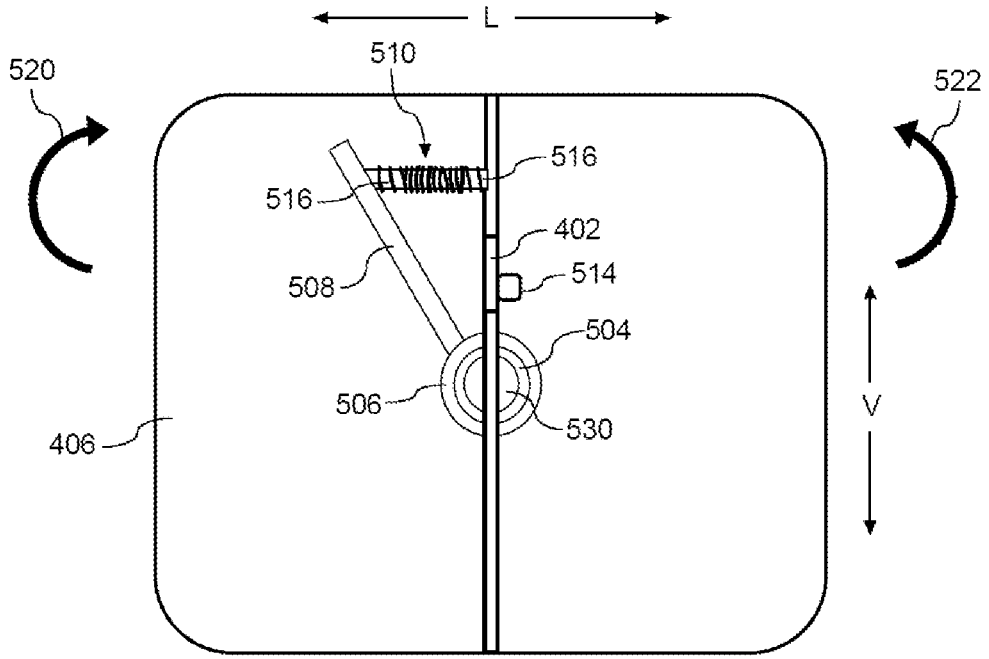
FIG. 6A depicts a rear view of tilting dead space storage assembly of FIG. 5 with storage cavity frame in a vertical position.
Figure 6B:
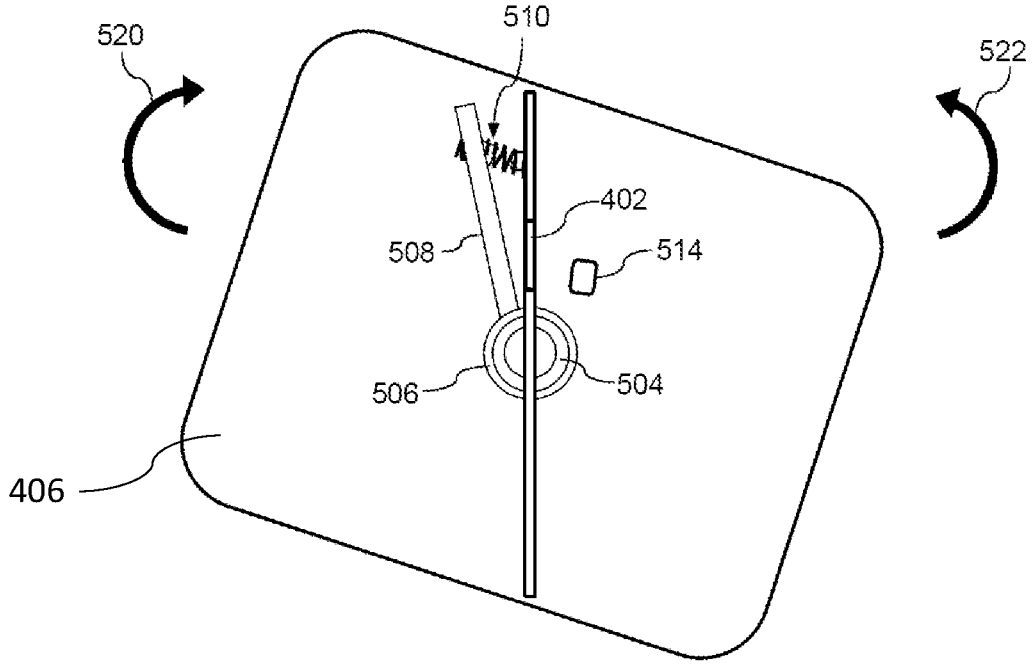
FIG. 6B depicts a rear view of the tilting dead space storage assembly of FIG. 5 with storage cavity frame in a rotated or tilted position.

Referring now generally to FIGS. 5, 6A and 6B. FIG. 5 depicts a perspective view of a tilting dead space storage assembly 500 according to an exemplary embodiment of the present disclosure. FIG. 6A depicts a rear view of the tilting assembly 502 of the rotating dead space storage assembly 500 of FIG. 5 in a vertical position. FIG. 6B depicts a rear view of the tilting assembly 502 of the tilting dead space storage assembly 500 of FIG. 5 in a tilted position. As depicted in FIGS. 5, 6A and 6B, tilting dead space storage assembly 500 can be turned or rotated, on an axis extending in a transverse direction T through the center 530 of hinge pin 504, by a user in a clockwise direction 520 to provide user with more convenient access to storage receptacle 408 to deposit or remove food items from storage cavity 408. However, it should be appreciated that another embodiment of the present disclosure could permit rotation or tilting of tilting dead space storage assembly 500 in a counterclockwise or anti-clockwise direction 522. In the exemplary embodiment shown in FIGS. 5, 6A and 6B, tilting dead space storage assembly 500 can tilt in a clockwise direction to approximately 35 degrees which allows retrieval of food items from or allows deposit of food items in storage receptacle 408, without permitting over-rotation which could result in unintended spillage of items from storage receptacle 408.

Tilting assembly 502 includes a hinge pin 504, hinge collar 506, stop bar 508, return spring 510 and stop nodule 514. Tilting dead space storage assembly 500 is configured for use in any suitable refrigerator appliance. As an example, tilting dead space storage assembly 500 may be positioned within chilled chamber 120 of refrigerator appliance 100 and utilized in any location along mounting track 142. Mounting tabs 404 of mounting bracket 402 can be inserted into mounting track 142 to support tilting dead space storage assembly 500. Tilting dead space storage assembly 500 can also include a rear plate 406, with a rear surface 512. Stop nodule 514 is affixed to rear surface 512 and extends in a transverse direction T away from rear surface 512 toward mounting tabs 404. Mounting bracket 402 includes a hinge pin 504. Hinge pin 504 can be a cylindrical protrusion extending from mounting bracket 402, in a transverse direction T, away from mounting tabs 404. Hinge pin 504 can be attached to mounting bracket 402 by known methods such as welding, screws, bolts, and/or clips. Alternatively, hinge pin 504 can be integrally formed with mounting bracket 402 to create a unitary assembly.

Hinge collar 506 is a hollow cylindrical protrusion extending from rear plate 406, in a transverse direction T, away from rear surface 512. Hinge collar 506 is affixed to rear plate 406 such that rear plate 406 and hinge collar 506 cannot move relative to one another. Hinge collar 506 can be attached to rear plate 406 by known methods such as welding, screws, bolts, and/or clips. Alternatively, hinge collar 506 can be integrally formed with rear plate 406 to create a unitary assembly. Hinge pin 504 and hinge collar 506 are configured such that hinge pin 504 can be inserted within hinge collar 506 allowing hinge collar 506 rotate around hinge pin 504 in a clockwise direction 520 and counterclockwise direction 522.

Return spring 510 is mounted to a node 516 located on stop bar 508 and a node located on mounting bracket 402. Stop bar 508 can be attached to hinge collar 506. Return spring 510 in situated or disposed between stop bar 508 and mounting bracket 402. In this way, when tilting dead space storage assembly 500 is rotated to the maximum angle (e.g., such as 35 degrees in the embodiment depicted in FIG. 6B) in the clockwise direction, stop bar 508 prevents further rotation by compressing return spring 510 or causing stop bar 508 to contact mounting bracket 402 as depicted in FIG. 6B. Thereafter, when the user ceases rotation in a clockwise direction 520, rotating dead space storage assembly 500 is rotated in an anti-clockwise direction 522 based on the force excerpted against stop bar 508 by compressed return spring 510. Said anti-clockwise rotation ceases when node 516 comes into contact with mounting bracket 402, which occurs when the rotating dead space storage assembly 500 is positioned vertically or at a rotation angle of approximately 0 degrees (as shown in FIGS. 5 and 6A).

Mounting bracket 402 is preferably formed from metal, such as aluminum, but can be formed from plastic or another suitable material. Rear plate 406 can be formed from plastic, metal or another suitable material. In some embodiments stop bar 508, hinge collar and rear plate 406 can be integrally formed as a single piece. In some embodiments mounting bracket 402 and hinge pin 504 can be integrally formed as a single piece. Rear plate 406 forms a rear surface 512 extending a lateral direction L and vertical direction V. Rear surface 512 is formed in a plane that is perpendicular to the transverse direction T.

Tilting dead space storage assembly 500 can also include a cavity frame 412. The cavity frame 412 and rear plate 406 define form storage receptacle 408 (which can also be referred to as a storage cavity). Cavity frame 412 includes a front portion 418, a right-side portion 414, a left-side portion 416 and a bottom portion 420. Front portion 418 extends between a right-side portion 414 and a left-side portion 416 (e.g., along the lateral direction L), and front portion 418 extends in a vertical direction V from bottom portion 420. Cavity frame 412 and rear plate 406 define a storage receptacle 408 which is accessible through opening 422 which allows for storage of food or other items within storage receptacle 408. Opening 422 extends between front portion 418 and rear plate 406 in a transverse direction T and extends between right-side portion 414 and left side portion 416 in a lateral direction L. Opening 422 faces bottom portion 420 in a vertical direction V. Cavity frame 412 also includes a left-side portion 416 and a right-side portion 414, both of which extend between a front portion 418 and rear surface 410, e.g., along the transverse direction T.

Figure 7:
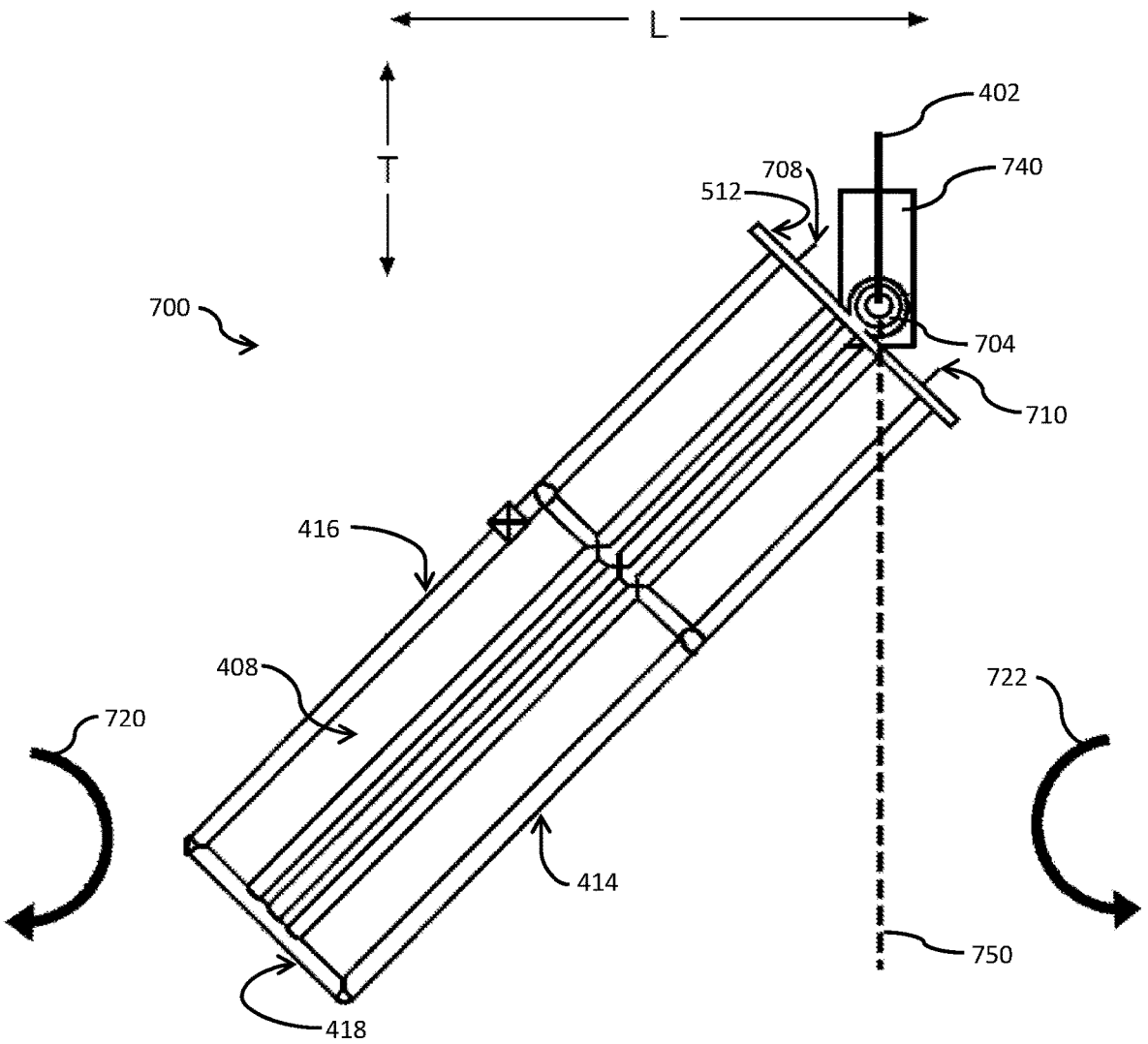
FIG. 7 depicts an overhead view of a pivoting dead space storage assembly according to an exemplary embodiment of the present disclosure depicted in a partially pivoted position.
Figure 8:
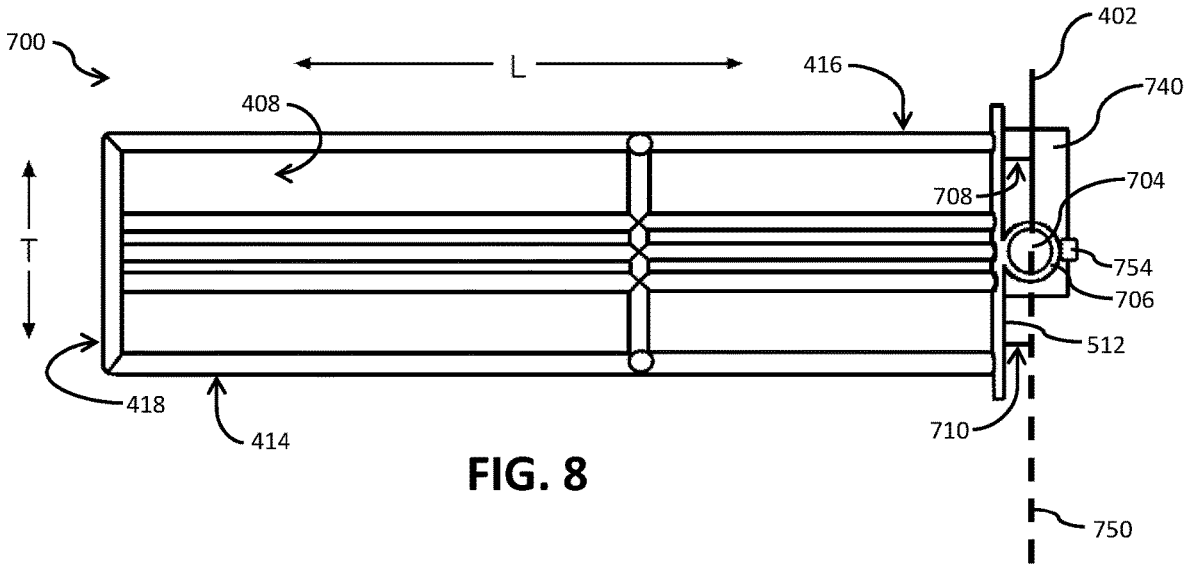
FIG. 8 depicts an overhead view of the pivoting dead space storage assembly of FIG. 7 depicted in a fully pivoted position.

Referring now generally to FIGS. 7 and 8. FIG. 7 depicts an overhead view of a pivoting dead space storage assembly 700 according to an exemplary embodiment of the present disclosure depicted in a partially pivoted position. FIG. 8 depicts an overhead view of the pivoting dead space storage assembly 700 of FIG. 7 depicted in a fully pivoted position.

Figure 9:
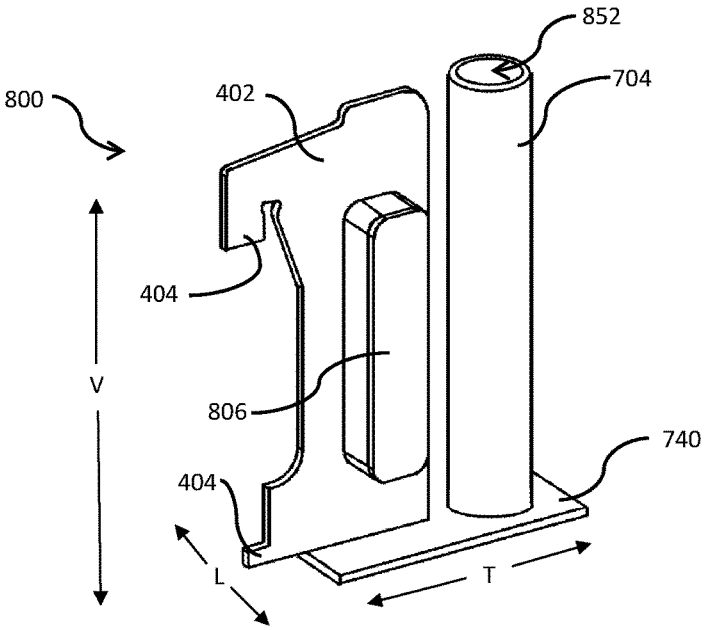
FIG. 9 depicts a perspective view of a hinge assembly for use with certain exemplary embodiments of dead space storage assemblies according to the present disclosure.

As depicted in FIGS. 7 and 8, pivoting dead space storage assembly 700 can be pivoted or rotated about a hinge assembly (such as hinge pin assembly 800 shown in FIG. 9). More specifically dead space storage assembly 700 can be pivoted or rotated about an axis formed in a vertical direction V at the center (which corresponds with the center point 852 of hinge pin 804 as shown in FIG. 9) of hinge pin 704. Pivoting dead space storage assembly 700 can be pivoted or rotated by a user in a left direction 720 and a right direction 722 to provide user with more convenient access to storage receptacle 408 to deposit or remove food items from storage receptacle 408 or to provide user with a plurality of positions for storage assembly 700. In the exemplary embodiment depicted in FIGS. 7 and 8, pivoting dead space storage assembly 700 can rotate in the left direction at an angle of up to approximately 90 degrees from centerline 750 of hinge pin 704 or until left stop nodule 708 is in physical contact with bracket 402 (as depicted in FIG. 8). Similarly, pivoting dead space storage assembly 700 can rotate in the right direction 722 at an angle of up to approximately 90 degrees from centerline 750 of hinge pin 704 or until right stop nodule 710 is in physical contact with bracket 402. Stop nodules 708 and 710 can be protrusion of any geometric shape extending from rear surface 512 of rear plate 406. Pivoting dead space storage assembly 700 can rotate at any angle between these maximum angles. For example, as shown in FIG. 7 pivoting dead space storage assembly 700 is pivoted in the left direction 720 at an angle of approximately 45 degrees from or relative to centerline 750 of hinge pin 704. Pivoting dead space storage assembly 700 can be temporarily locked into position (i.e., such that it does not pivot) at 90 degrees in the right direction 722 of centerline 750, along centerline 750 (i.e., with pivoted at 0 degrees relative to centerline 750) and at 90 degrees in the left direction 720 of centerline 750. Pivoting dead space storage assembly 700 is temporarily locked in said positions with a latch mechanism 754. Latch mechanism 754 can be a locking pin, rod or other known latch mechanism which engages hinge pin 704 and/or hinge collar 706 such that hinge collar 706 is prevented from pivoting or moving relative to hinge pin 704. While latch mechanism 754 is shown in exemplary embodiment of a dead space storage assembly 700 depicted in FIG. 8, it should be appreciated that a latch mechanism 754 can also be utilized with the exemplary embodiments of dead space storage assemblies 1100 and 1500 shown in FIGS. 11 and 15.

Pivoting dead space storage assembly 700 includes a hinge pin 704, hinge collar 706, left stop nodule 708, right stop nodule 710. Pivoting dead space storage assembly 700 can be used in any suitable refrigerator appliance. As an example, pivoting dead space storage assembly 700 may be positioned within chilled chamber 120 of refrigerator appliance 100 and utilized in any location along mounting track 142. More specifically, mounting tabs 404 (not shown in FIGS. 7 and 8) of mounting bracket 402 can be inserted into mounting track 142 to support pivoting dead space storage assembly 700. Pivoting dead space storage assembly 700 can also include a rear plate 406, with a rear surface 512. Hinge pin 704 can be a cylindrical member extending upward, in a vertical direction V, from bracket base 740. Bracket base 740 can be a member forming a surface extending in a transverse direction T and a lateral direction L forming a plane which is perpendicular to vertical direction V. Bracket base 740 can be attached to mounting bracket 402 by known methods such as welding, screws, bolts, and/or clips. Alternatively, hinge pin 704 can be integrally formed with bracket base 740 to create a unitary assembly.

Hinge collar 706 can be a hollow cylindrical member affixed to rear surface 512. Rear surface 512 and hinge collar 706 are affixed to one another such that hinge collar 706 cannot move relative to rear surface 512. Hinge collar 706 can be attached to rear surface 512 by known methods such as welding, screws, bolts, and/or clips. Alternatively, hinge collar 706 can be integrally formed with rear plate 406 to create a unitary assembly. Hinge pin 704 and hinge collar 706 are configured such that hinge pin 704 can be inserted within hinge collar 706 allowing hinge collar 706 rotate around hinge pin 704 in a left direction 720 and right direction 722 on an axis extending in a vertical direction V through the center of hinge pin 704.

Pivoting dead space storage assembly 700 can also include a cavity frame 412. The cavity frame 412 and rear plate 406 define form storage cavity 408. Cavity frame 412 includes a front portion 418, a right-side portion 414, a left-side portion 416 and a bottom portion 420. Front portion 418 extends between a right-side portion 414 and a left-side portion 416 (e.g., along the lateral direction L), and front portion 418 extends in a vertical direction V from bottom portion 420. Cavity frame 412 and rear plate 406 define a storage receptacle 408 which is accessible through opening 422 which allows for storage of food or other items within storage receptacle 408. Opening 422 extends between front portion 418 and rear plate 406 in a transverse direction T and extends between right-side portion 414 and left side portion 416 in a lateral direction L. Opening 422 faces bottom portion 420 in a vertical direction V. Cavity frame 412 also includes a left-side portion 416 and a right-side portion 414, both of which extend between a front portion 418 and rear surface 410, e.g., along the transverse direction T.

Referring now to FIG. 9. FIG. 9 depicts a perspective view of a hinge assembly 800 according to an exemplary embodiment of the present subject matter. It should be appreciated that certain portions or configurations of hinge assembly 800 can be utilized with the pivoting dead space storage assemblies depicted in FIGS. 7, 8 and 10 or with the sliding dead space storage assemblies depicted in FIGS. 11, 12, 15 and 16. For example, hinge assembly 800 can be utilized with the pivoting dead space storage assemblies depicted in FIGS. 7 and 8 without the inclusion of magnets 806 and 808. Similarly, hinge assembly 800 can be utilized with the sliding dead space storage assemblies depicted in FIGS. 11, 12 and 15 without the inclusion of magnets 806 and 808.

Figure 10:
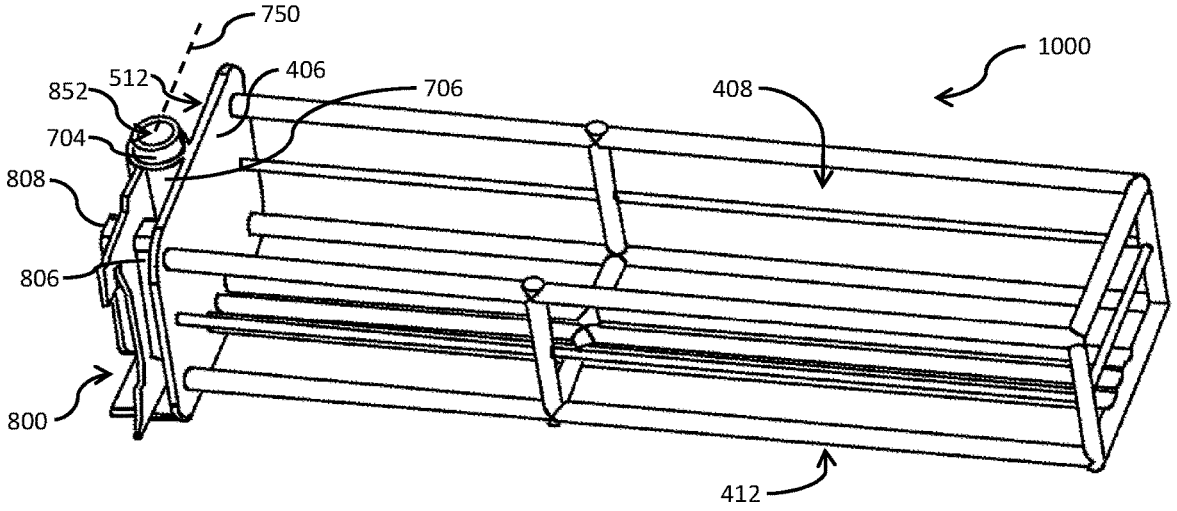
FIG. 10 depicts a perspective view of a pivoting dead space storage assembly according to another exemplary embodiment of the present disclosure depicted in a fully pivoted position.
Figure 11:
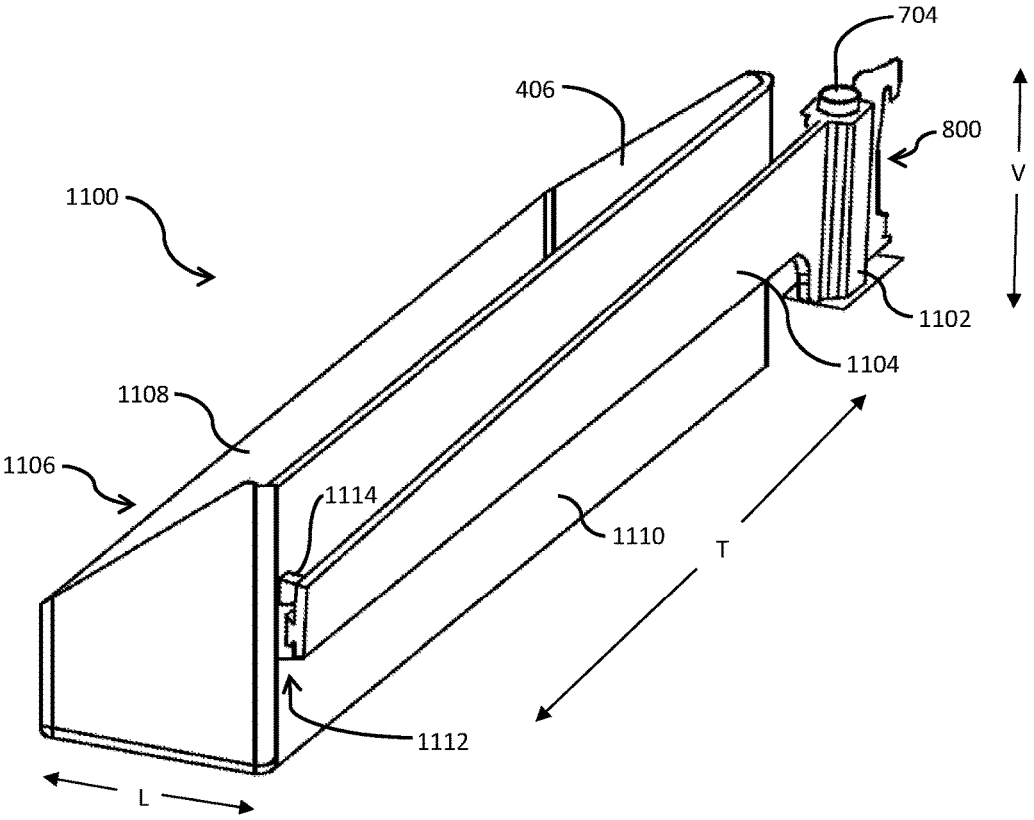
FIG. 11 depicts a perspective view of a sliding dead space storage assembly, in a fully retracted position, according to an exemplary embodiment of the present disclosure.
Figure 15:
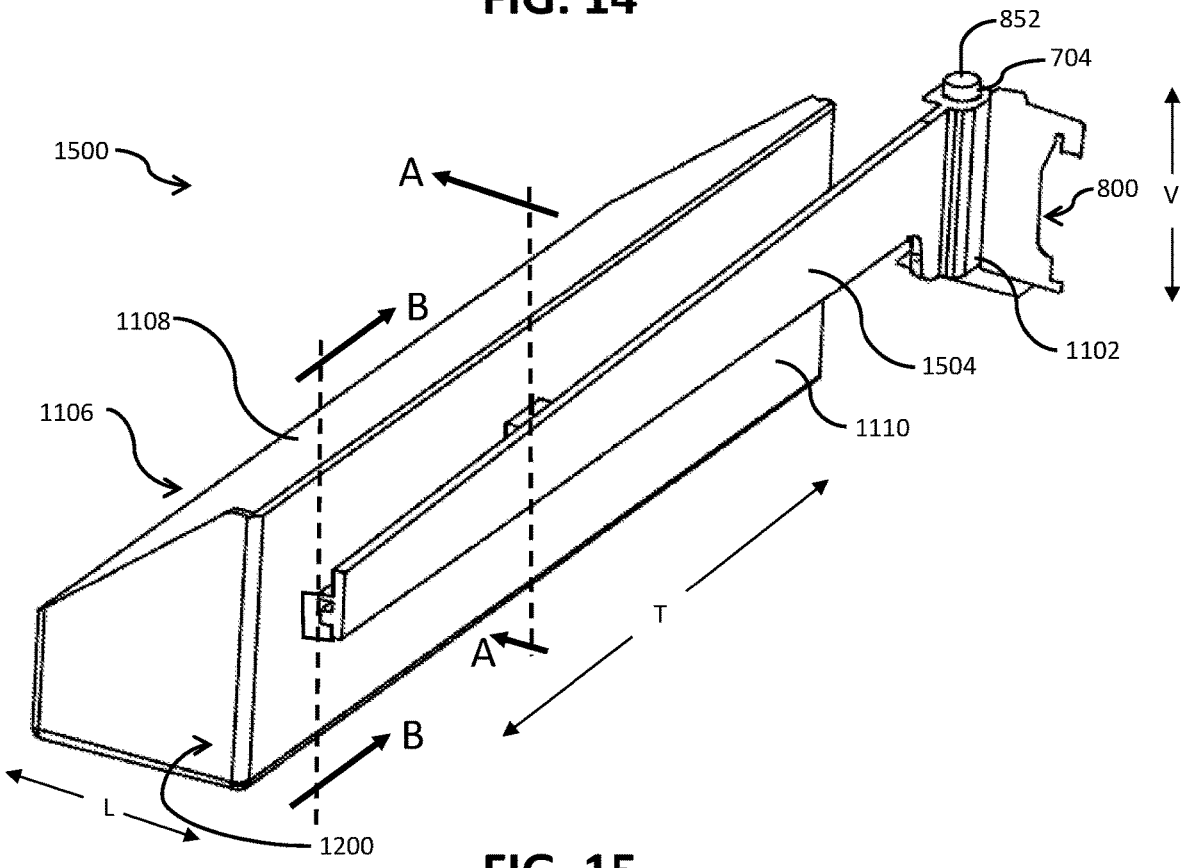
FIG. 15 depicts a perspective view of another exemplary embodiment of a sliding dead space storage assembly in a fully retracted position.

Hinge assembly 800 can include a hinge pin 704, which is configured to fit within a hinge collar (such as hinge collar 706 of FIGS. 8, 9 and 10 and hinge collar 1102 of FIGS. 11 and 15). Hinge assembly 800 may be positioned within chilled chamber 120 of refrigerator appliance 100 and utilized in any location along mounting track 142. Hinge assembly 800 can include mounting tabs 404 and a mounting bracket 402. Mounting tabs 404 can be inserted into mounting track 142 to support hinge assembly 800. Hinge pin 704 can be a cylindrical member extending upward, in a vertical direction V, from bracket base 740. Bracket base 740 can be a member forming a surface extending in a transverse direction T and a lateral direction L forming a plane which is perpendicular to vertical direction V. Bracket base 740 can be attached to mounting bracket 402 by known methods such as welding, screws, bolts, and/or clips. Alternatively, hinge pin 704 can be integrally formed with bracket base 740 to create a unitary assembly. Hinge pin 704 can define an axis, extending in a vertical direction V at center point 852 the center of hinge pin 704. Dead space storage assemblies 700 and 1000 can be pivoted or rotated about the axis formed in the vertical direction V at center point 852 of hinge pin 704. Hinge assembly 800, can also include a left magnet 806 and a right magnet 808 (shown in FIG. 10) affixed to mounting bracket 402. As described further herein, magnets 806 and 808 can function as a latch mechanism (such as latch mechanism 754 of storage assembly 700) such that hinge collar 706 is prevented from pivoting or moving relative to hinge pin 704.

Referring now to FIG. 10. FIG. 10 depicts a perspective view of a pivoting dead space storage assembly 1000 according to an exemplary embodiment of the present disclosure depicted in a fully pivoted position.

Dead space storage assembly 1000 includes a hinge collar 706 affixed to rear plate 406. The cavity frame 412 and rear plate 406 of pivoting dead space storage assembly 1000, can be pivoted or rotated about hinge pin 704 of hinge assembly 800 (shown in FIG. 9). The storage receptacle 408 of dead space storage assembly 1000 can be pivoted or rotated about an axis formed in a vertical direction V at center point 852 of hinge pin 704. The cavity frame 412 and rear plate 406 (i.e., the storage receptacle 408) of dead space storage assembly 1000 can be pivoted or rotated by a user in a left direction and a right direction (in the same manner as described and depicted with respect to pivoting dead space storage assembly 700 of FIGS. 7 and 8) to provide a user with more convenient access to storage cavity 408 to deposit or remove food items from storage receptacle 408 or to provide user with a plurality of positions for storage assembly 1000. In the exemplary embodiment depicted in FIG. 10, the cavity frame 412 and rear plate 406 (i.e., the storage receptacle 408) of pivoting dead space storage assembly 1000 can rotate in the left direction at an angle of up to approximately 90 degrees from centerline 750 of hinge pin 704 or until left magnet 806 is in physical contact with rear plate 406 (as depicted in FIG. 10). Similarly, the storage receptacle 408 of pivoting dead space storage assembly 1000 can rotate in the right direction at an angle of up to approximately 90 degrees from centerline 750 of hinge pin 704 or until right magnet 808 is in physical contact with rear plate 406. Magnets 806 and 808 are in magnet communication with rear plate 406 to hold storage receptacle 408 in the pivoted position (i.e., 90 degrees left or right of centerline 750) by magnetic force. Pivoting dead space storage assembly 1000 can rotate at any angle between these maximum angles (i.e., 90 degrees to the right or left of centerline 750). For example, pivoting dead space storage assembly 1000 can be pivoted in a left or right direction at an angle of approximately 45 degrees from or relative to centerline 750 of hinge pin 704. Pivoting dead space storage assembly 1000 can be secured into position at 90 degrees in the right direction of centerline 750, along centerline 750 (i.e., pivoted at 0 degrees relative to centerline 750) and at 90 degrees in the left direction of centerline 750 (as shown in FIG. 10). Pivoting dead space storage assembly 1000 is secured or held in said positions with magnets 806 and 808 such that storage receptacle 408 does not move/pivot without user manipulation of the cavity frame 412 (i.e., held by magnets 806 and 808 such that pivoting dead space storage assembly 1000 does not pivot without a user applying force to cavity frame 412 in a left direction or right direction). Magnets 806 and 808 engage mounting bracket 802 and rear plate 406 such that hinge collar 706 is prevented from pivoting or moving relative to hinge pin 704.

Pivoting dead space storage assembly 1000 includes a hinge pin 704 and hinge collar 706. Pivoting dead space storage assembly 1000 can be used in any suitable refrigerator appliance. As an example, pivoting dead space storage assembly 1000 may be positioned within chilled chamber 120 of refrigerator appliance 100 and utilized in any location along mounting track 142. More specifically, mounting tabs 404 of mounting bracket 402 can be inserted into mounting track 142 to support pivoting dead space storage assembly 1000. Pivoting dead space storage assembly 1000 can also include a rear plate 406, with a rear surface 512. Hinge pin 704 can be a cylindrical member extending upward, in a vertical direction V, from bracket base 740. Bracket base 740 can be a member forming a surface extending in a transverse direction T and a lateral direction L forming a plane which is perpendicular to vertical direction V. Bracket base 740 can be attached to mounting bracket 402 by known methods such as welding, screws, bolts, and/or clips. Alternatively, hinge pin 704 can be integrally formed with bracket base 740 to create a unitary assembly.

Hinge collar 706 can be a hollow cylindrical member affixed to rear plate 406. Rear surface 512 and hinge collar 706 are affixed to one another such that hinge collar 706 cannot move relative to rear surface 512. Hinge collar 706 can be attached to rear surface 512 by known methods such as welding, screws, bolts, and/or clips. Alternatively, hinge collar 706 can be integrally formed with rear plate 406 to create a unitary assembly. Hinge pin 704 and hinge collar 706 are configured such that hinge pin 704 can be inserted within hinge collar 706 allowing hinge collar 706 rotate around hinge pin 704 in a left direction and right direction (such as 720 and 722 of FIG. 7) on an axis extending in a vertical direction V through the center point 852 of hinge pin 704.

Pivoting dead space storage assembly 700 can also include a cavity frame 412. The cavity frame 412 and rear plate 406 define form storage cavity 408. Cavity frame 412 includes a front portion 418, a right-side portion 414, a left-side portion 416 and a bottom portion 420. Front portion 418 extends between a right-side portion 414 and a left-side portion 416 (e.g., along the lateral direction L), and front portion 418 extends in a vertical direction V from bottom portion 420. Cavity frame 412 and rear plate 406 define a storage receptacle 408 which is accessible through opening 422 which allows for storage of food or other items within storage cavity 408. Opening 422 extends between front portion 418 and rear plate 406 in a transverse direction T and extends between right-side portion 414 and left side portion 416 in a lateral direction L. Opening 422 faces bottom portion 420 in a vertical direction V. Cavity frame 412 also includes a left-side portion 416 and a right-side portion 414, both of which extend between a front portion 418 and rear surface 410, e.g., along the transverse direction T.

Referring generally now to FIGS. 11 through 14. FIG. 11 depicts a perspective view of a sliding dead space storage assembly, in a fully retracted position, according to an exemplary embodiment of the present disclosure. Sliding dead space storage assembly 1100 includes a hinge collar 1102 affixed to a mounting arm 1104 and a storage receptacle 1106.

Storage receptacle 1106 of sliding dead space storage assembly 1100, can be moved by a user in a transverse direction along track protrusion 1118. Storage receptacle 1106 and mounting arm 1104 of sliding dead space storage assembly 1100 can also be rotated by a user in a left direction and in a right direction (in the same manner as described and depicted with respect to pivoting dead space storage assembly 700 of FIGS. 7 and 8) to provide a user with more convenient access to storage receptacle 1106 to deposit food items in or remove food items from storage receptacle 1106 or to provide user with a plurality of positions for sliding dead space storage assembly 1100. Storage receptacle 1106 includes a first side 1108 and second side 1110. The height of first side 1108, in the vertical direction V, is less than the height, in the vertical direction V, of second side 1110. In this configuration, when sliding dead space storage assembly 1100 is placed within chilled chamber 120 of refrigerator 100, second side 1110 is situated such that it is closer to the cabinet 110 as compared to first side 1108. When so situated, a user is permitted easier or more convenient access to food items within the storage receptacle 1106 because of the lesser vertical height of first side 1108.

Sliding dead space storage assembly 1100 includes a track assembly 1112 which permits or enables storage receptacle 1106 to move in a transverse direction T relative to mounting arm 1104. Track assembly 1112 includes a first stop boss 1114 affixed to mounting arm 1104 (also shown in FIG. 13) and a second stop boss 1116 (shown in FIGS. 12 and 14) affixed to storage receptacle 1106. When first stop boss 1114 and second stop boss 1116 come into physical contact, the storage receptacle 1106 has reached the fully extended position (as shown in FIG. 12) and the stop bosses 1114 and 1116 stop the sliding movement of storage receptacle 1106 in a transverse direction T away from hinge assembly 800.

Figure 12:
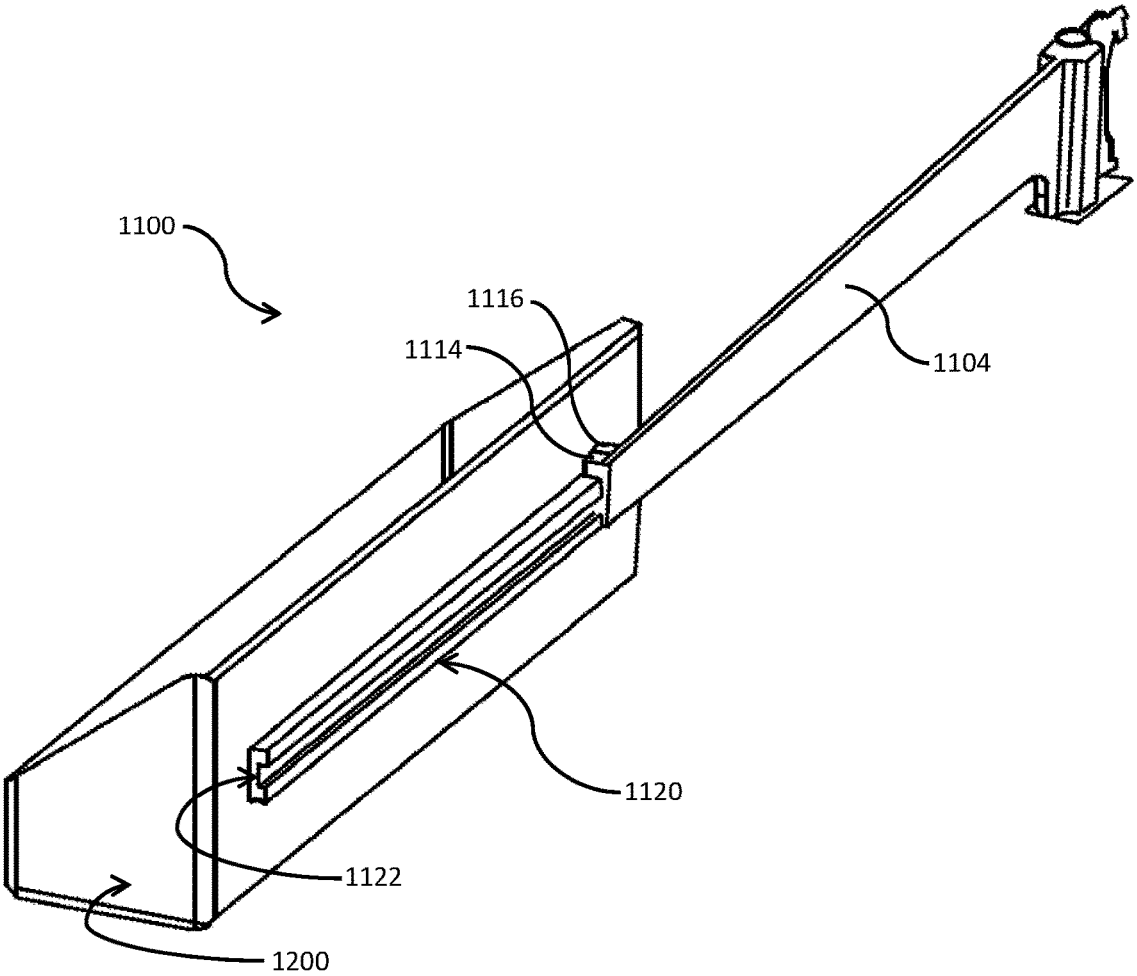
FIG. 12 depicts a perspective view of the sliding dead space storage assembly of FIG. 11 in a fully extended position.
Figure 13:
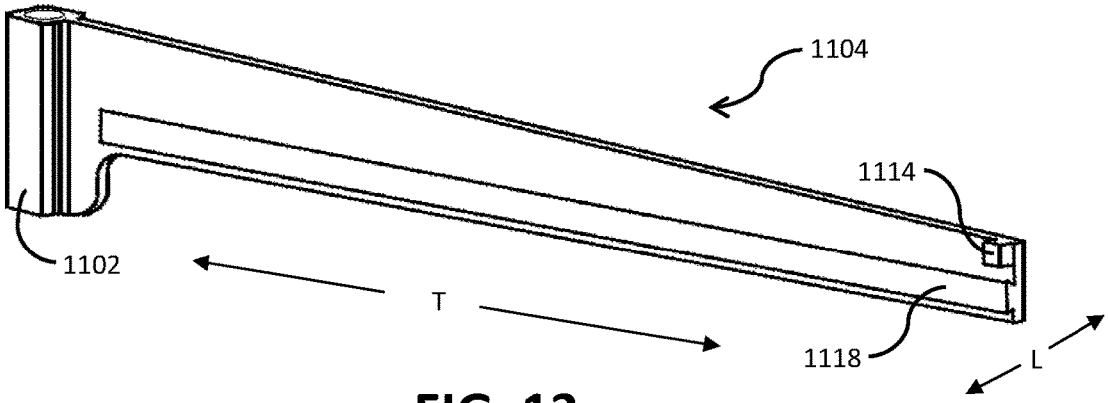
FIG. 13 depicts a perspective view of the mounting bracket of the sliding dead space storage assembly of FIGS. 11 and 12.
Figure 14:
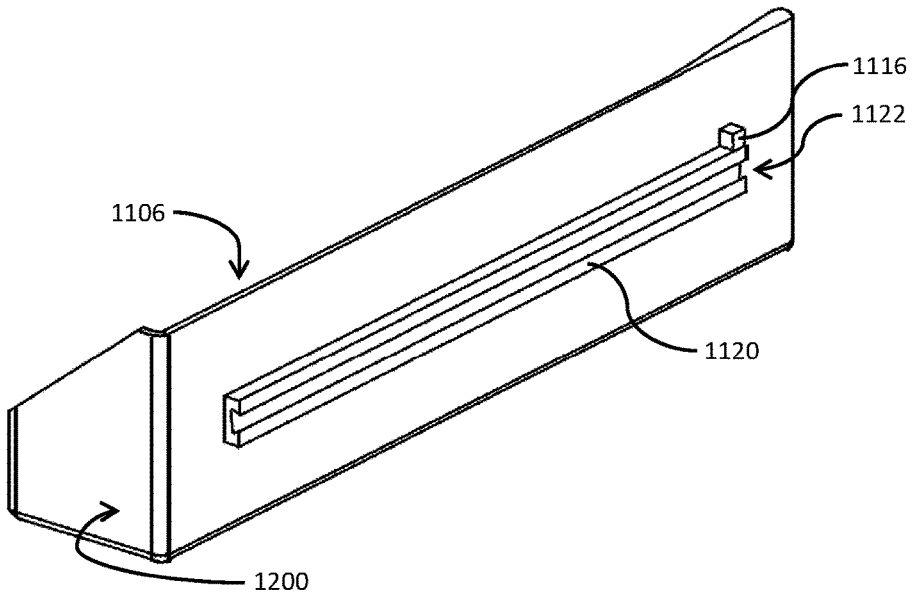
FIG. 14 depicts a perspective view of a storage receptacle of the sliding dead space storage assembly of FIGS. 11 and 12.

FIG. 12 depicts a perspective view of the sliding dead space storage assembly of FIG. 11, in a fully extended position. FIG. 13 depicts a perspective view of a mounting bracket of the sliding dead space storage assembly of FIGS. 11 and 12. FIG. 14 depicts a perspective view of a storage container of the sliding dead space storage assembly of FIGS. 11 and 12. Sliding dead space storage assembly 1100 further includes track assembly 1112. Track assembly includes a track protrusion 1118 (shown in FIG. 13) and a receiving track 1120. Track protrusion 1118 extends from mounting arm 1104, in a lateral direction L as shown in FIG. 13. Track protrusion 1118 can be affixed to mounting arm 1104 by known methods (e.g., glue or mechanical fasteners) or track protrusion 1118 can be integrally formed as part of mounting arm 1104. Receiving track 1120 is affixed to second side 1110 of storage receptacle 1106, as shown in FIGS. 12 and 14. Receiving track 1120 can be affixed to storage receptacle 1106 by known methods (e.g., glue or mechanical fasteners) or receiving track 1120 can be integrally formed as part of storage receptacle 1106. Receiving track 1120 includes a receiving slot 1122. Receiving slot 1122 is configured such that track protrusion 1118 fits within receiving slot 1122. In this manner receiving track 1120 and track protrusion 1118 slidably attach storage receptacle 1106 to mounting arm 1104.

Referring generally now to FIGS. 15 through 19. FIG. 15 depicts a perspective view of another exemplary embodiment of a sliding dead space storage assembly 1500 in a fully retracted position. Sliding dead space storage assembly 1500 includes a hinge collar 1102 affixed to a mounting bracket 1504 and a storage receptacle 1106. Storage receptacle 1106 of sliding dead space storage assembly 1500, can be pivoted or rotated about hinge pin 704 of hinge assembly 800 (shown in further detail in FIG. 9). Storage receptacle 1106 of sliding dead space storage assembly 1500 can be pivoted or rotated about an axis formed in a vertical direction V at center point 852 of hinge pin 704. Storage receptacle 1106 of sliding dead space storage assembly 1100 can be rotated by a user in a left direction and a right direction (in the same manner as described and depicted with respect to pivoting dead space storage assembly 700 of FIGS. 7 and 8) to provide a user with more convenient access to storage receptacle 1106 to deposit food items in or remove food items from storage receptacle 1106 or to provide user with a plurality of positions for sliding dead space storage assembly 1100. Storage receptacle 1106 includes a first side 1108 and second side 1110. The height of first side 1108, in the vertical direction V, is less than the height, in the vertical direction V, of second side 1110. In this configuration, when sliding dead space storage assembly 1500 is placed within chilled chamber 120 of refrigerator 100, second side 1110 is situated such that it is closer to the cabinet 110 as compared to first side 1108. When so situated, a user is permitted easier or more convenient access to food items within the storage receptacle 1106 because of the lesser vertical height of first side 1108.

Sliding dead space storage assembly 1100 can be extended, in a transverse direction T, outward toward front 105 of refrigerator appliance 100 along track assembly 1112 to provide user with more convenient access to storage receptacle 1106 to deposit food items in or remove food items from storage receptacle 1106.

Sliding dead space storage assembly 1100 is configured for use in any suitable refrigerator appliance. As an example, sliding dead space storage assembly 1100 may be positioned within chilled chamber 120 of refrigerator appliance 100 and utilized in any location along mounting track 142. More specifically, mounting tabs 404 of mounting bracket 402 can be inserted into mounting track 142 to support sliding dead space storage assembly 1100. Alternatively, hinge assembly 800 can be omitted from sliding dead space storage assembly 1100 and mounting arm 1104 can be situated within chilled chamber 120 and mechanically attached to at least one of the right-side portion 106 or the left side portion 108 (shown in FIG. 2) of refrigerator appliance 100. Mounting arm 1104 can be attached to the right-side portion 106 or the left side portion 108 by known methods such as welding, screws, bolts, and/or clips. Alternatively, mounting arm 1104 can be integrally formed with cabinet housing 110 within chilled chamber 120 to create a unitary assembly.

Track protrusion 1118 corresponds to a receiving slot 1122. Receiving slot 1122 is configured such that track protrusion 1118 fits within receiving slot 1122 and holds storage receptacle 1106 in a vertical direction V and permits storage receptacle 1106 to slide along track protrusion 1118 in a transverse direction T.

Track assembly 1112 is preferably formed from metal, such as aluminum, but can be formed from plastic or another suitable material. When storage receptacle 1106 is in a fully extended position (as shown in FIG. 12) at least a portion of storage receptacle 1106 can be extended outside of chilled chamber 120, away from rear wall 144, in a transverse direction T. Mounting arm 1104 is mounted within chilled chamber such track protrusion 1118 is angled downward in a vertical direction V as track extends in a transverse direction T toward interior rear wall 144. The downward angle of the track protrusion 1118 can be between 8° and 12°. In this way, if a user does not push back the storage receptacle 1106 back into the chilled chamber 120 after user pulls or extends storage receptacle 1106 out to the fully extended position (depicted in FIG. 12), as door 124 is closed, due to the angled or tapered track protrusion 1118, door 124 will contact front portion 1200 and push storage receptacle 1106 in a transverse direction T along track protrusion 1118 toward rear wall 144 to a fully retracted position (as shown in FIG. 11). In the fully retracted position, storage receptacle 1106 is situated entirely within chilled chamber 120. These features avoid unintentional damage to sliding dead space storage assembly 1100 and the door 124.

Storage receptacle 1106 can be formed from plastic, metal or another suitable material. As shown in FIGS. 11, 12 and 14 when sliding dead space storage assembly 1100 is configured to be mounted on or near right-side portion 106 of refrigerator 100, second side 1110 of storage receptacle has a greater dimension in a vertical direction V compared to first side 1108. In this way, the opening of storage receptacle 1106 is slanted or titled inward to the center of chilled chamber allowing for more convenient user access to food items within storage receptacle 1106. Similarly, when sliding dead space storage assembly 1100 is configured to be mounted on or near left-side portion 108 of refrigerator 100, first side 1108 has a greater dimension in a vertical direction V compared to second side 1110. In this way, the opening of storage receptacle 1106 is slanted or titled inward to the center of chilled chamber allowing for more convenient user access to food items within storage receptacle 1106.

Figure 16:
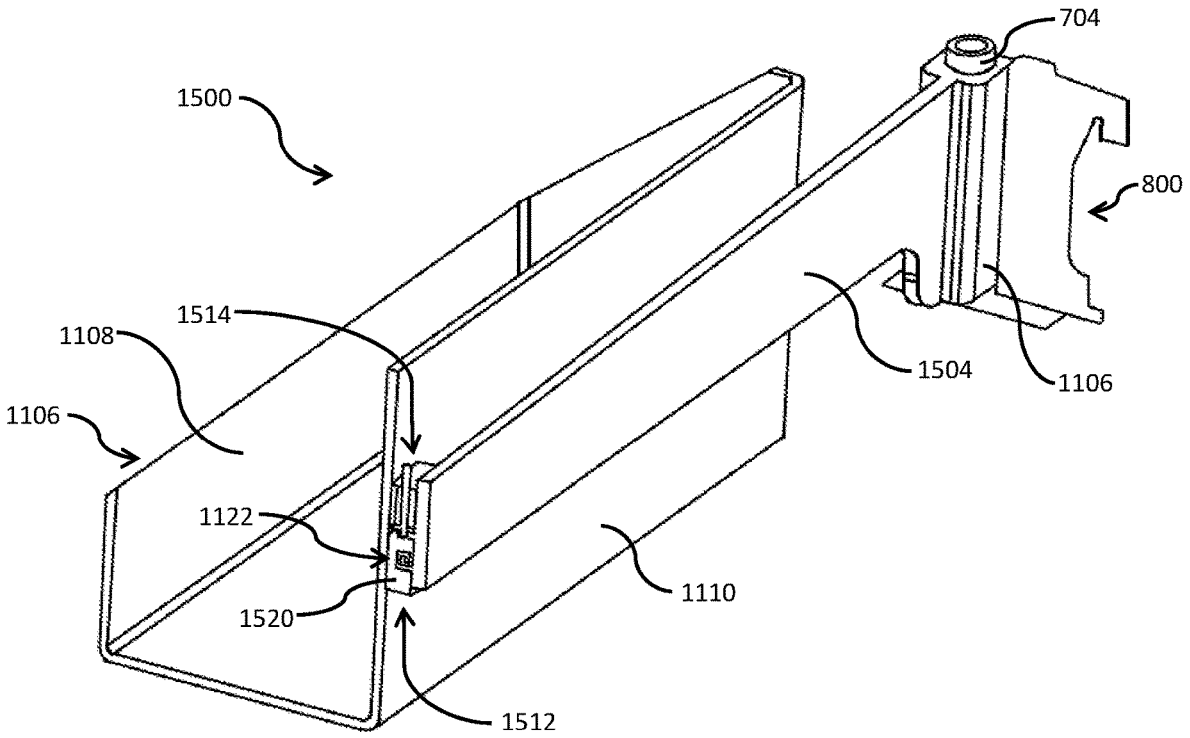
FIG. 16 depicts a partial perspective section view of the sliding dead space storage assembly of FIG. 15 taken along the A-A section line of FIG. 15.
Figure 17:
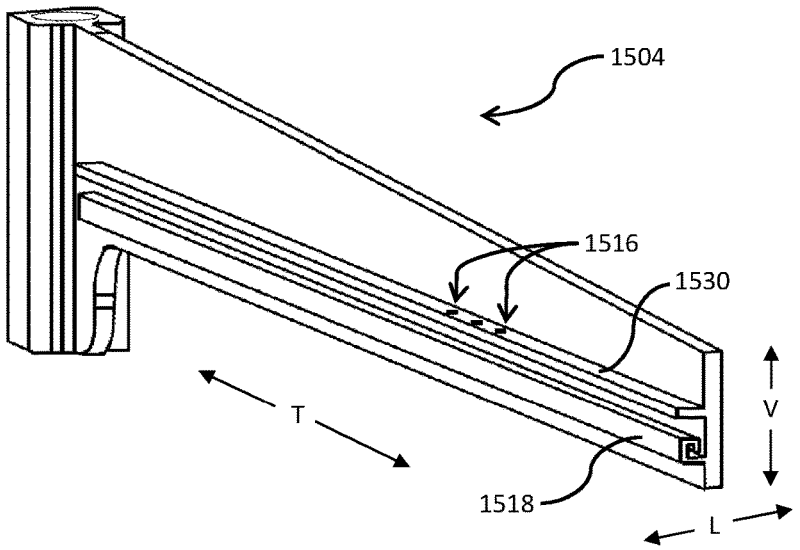
FIG. 17 depicts a perspective view of the mounting bracket of the sliding dead space storage assembly of FIG. 15.
Figure 18:
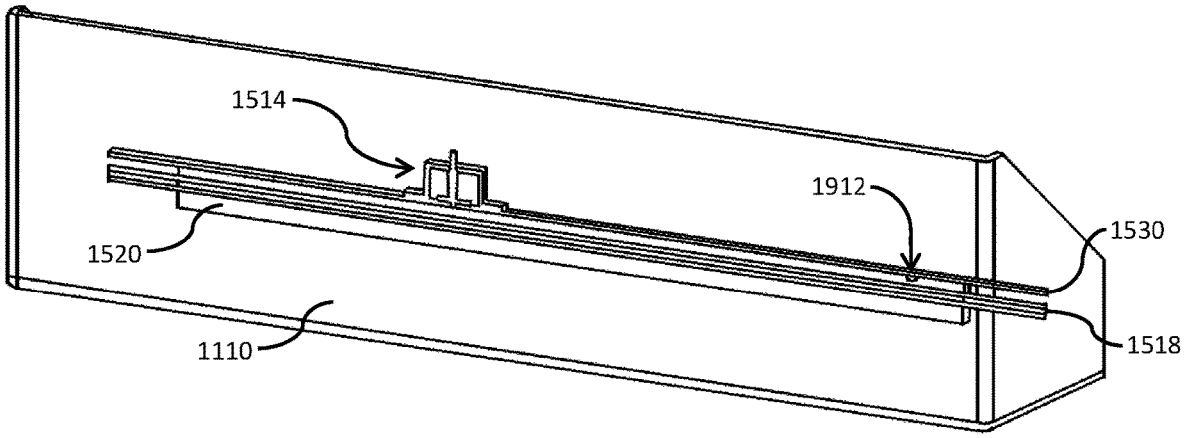
FIG. 18 depicts a partial perspective section view of the sliding dead space storage assembly of FIG. 15, taken along the B-B section line of FIG. 15, to provide an unobstructed view of the interface between the track protrusion and the receiving track of the sliding dead space storage assembly of FIG. 15.

Referring generally now to FIGS. 16, 17 and 18. FIG. 16 depicts a partial section view of the sliding dead space storage assembly of FIG. 15 taken along the A-A section line of FIG. 15. FIG. 17 depicts a perspective view of a mounting bracket of the sliding dead space storage assembly of FIGS. 15 and 16. FIG. 18 depicts a partial perspective view of the sliding dead space storage assembly 1500 of FIGS. 15 and 16, taken along the B-B section line of FIG. 15 without the inclusion of certain portions of the mounting bracket shown in FIG. 17, in order to provide an unobstructed view of the interface between the bracket guide and the storage bin guide of the sliding dead space storage assembly of FIGS. 15 and 16.

Sliding dead space storage assembly 1500 includes a track assembly 1512 which permits or enables the storage receptacle 1106 to move in a transverse direction T relative to mounting arm 1104. Track assembly 1512 includes a plunger assembly 1514 (shown in FIG. 19) affixed to bracket 1504 at mounting points 1516 located on guide member 1530. As discussed in further detail herein, plunger assembly 1514 and guide member 1530 cooperate to stop the sliding movement of storage receptacle 1106 in a transverse direction T and temporarily fix storage receptacle 1106 in a user desired position along the transverse direction T.

Sliding dead space storage assembly 1500 further includes track assembly 1512. Track assembly includes a track protrusion 1518 (shown in FIG. 17) and a receiving track 1520. Track protrusion 1518 extends from bracket 1504, in a lateral direction L and extends along bracket 1504 in a transverse direction T, as shown in FIG. 17. Guide member 1530 extends from bracket 1504, in a lateral direction L and extends along bracket 1504 in a transverse direction T, as shown in FIG. 17. Guide member 1530 is situation above, in a vertical direction V, track protrusion 1518. Track protrusion 1518 and guide member 1530 can be affixed to bracket 1504 by known methods (e.g., glue or mechanical fasteners) or track protrusion 1518 and guide member 1530 can be integrally formed as part of bracket 1504. Receiving track 1520 is affixed to second side 1110 of storage receptacle 1106, as shown in FIGS. 16 and 18. Receiving track 1520 can be affixed to storage receptacle 1106 by known methods (e.g., glue or mechanical fasteners) or receiving track 1520 can be integrally formed as part of storage receptacle 1106. Receiving track 1520 includes a receiving slot 1122. Receiving slot 1122 is configured such that track protrusion 1518 fits within receiving slot 1122. In this manner receiving track 1520 and track protrusion 1518 slidably attach storage receptacle 1106 to mounting arm 1104.

Figure 19:
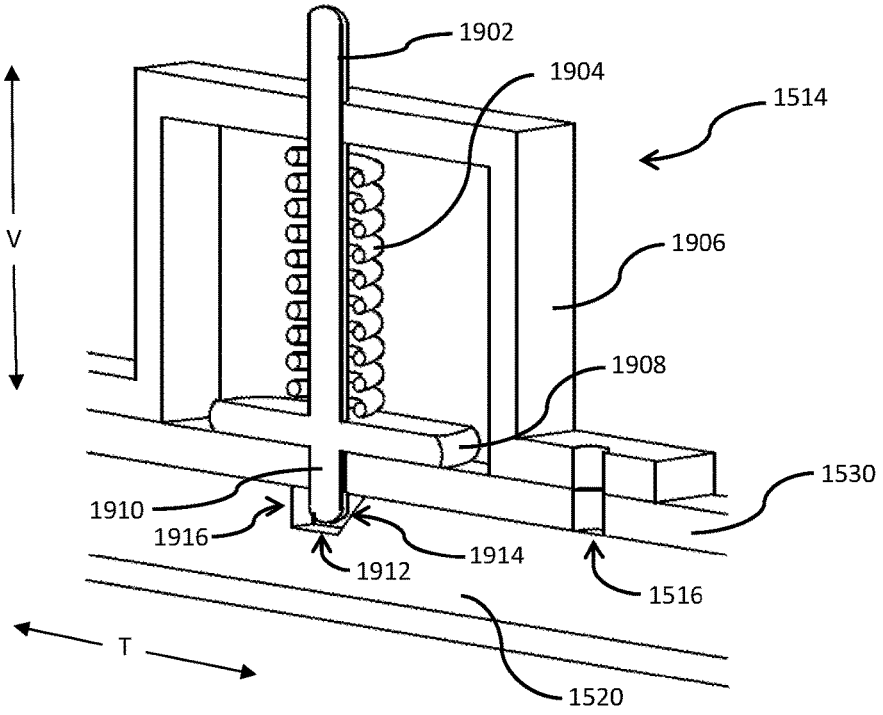
FIG. 19 depicts a partial section view of the plunger assembly of the sliding dead space storage assembly of FIG. 15 taken along the B-B section line of FIG. 15.

FIG. 19 depicts a partial section view of the plunger assembly 1514 of the sliding dead space storage assembly of FIGS. 15, 16 and 18 taken along the B-B section line of FIG. 18. Plunger assembly 1514 includes a plunger 1902, a return spring 1904 and retention bracket 1906. Retention bracket 1906 is attached to guide member 1530 at mounting points 1516 (e.g., with screws, rivets or bolts). Plunger 1902 includes a flange 1908. Return spring 1904 is in contact with retention bracket 1906 and flange 1908 such that it exerts force against flange in a downward vertical direction V away from retention bracket 1906. Plunger assembly 1514 attached to the guide member 1530, wherein a least of portion of plunger assembly 1514 is configured to be accepted within a void 1912 situated within the receiving track 1520.

Plunger 1902 includes a pin 1910 which extends below flange 1908. Pin 1920 can pass through guide surface 1530 and into one of a plurality of voids 1912 formed within receiving track 1520. The plurality of voids 1912 can correspondence to the fully extended and fully retracted positions of the storage receptacle 1106. Pin 1910 can extend into void 1912 and thereby prevent storage receptacle 1106 from sliding along track protrusion 1118 in a transverse direction T.

Void 1912 includes a holding surface 1916. When pin 1910 is situated within void 1912, holding surface 1916 can contact pin 1910 and prevent storage receptacle 1106 from moving in a transverse direction T along track protrusion 1518 away from rear wall 144. User can pull plunger 1902 upward, in a vertical direction V, such that no portion of pin 1910 is situation within void 1912. This will allow the user to slide storage receptacle 1106 in a transverse direction T along track protrusion 1518 away from rear wall 144 to a fully extended position (such as shown in FIG. 12).

Void 1912 can include a ramp 1914, which operates to push pin 1910 upward in a vertical direction V when a user pushes storage receptacle 1106 in a transverse direction T into chilled chamber 120. In this way, if a user does not push back the storage receptacle 1106 back into the chilled chamber 120 after user pulls or extends storage receptacle 1106 out to the fully extended position (depicted in FIG. 12), as door 124 is closed, door 124 will contact front portion 1200 and push storage receptacle 1106 in a transverse direction T along track protrusion 1518 toward rear wall 144 to a fully retracted position (as shown in FIG. 15). In turn, pin 1910 will contact ramp 1914 and push pin 1910 upward in a vertical direction V until no portion of pin 1910 is within void 1912. In this way, the storage receptacle 1106 can be moved from the fully extended to the fully retracted position without user manipulation of the plunger assembly 1514. In the fully retracted position, storage receptacle 1106 is situated entirely within chilled chamber 120.

Although specific features of various embodiments may be shown in some drawings and not in others, this is for convenience only. In accordance with the principles of the present disclosure, any feature of a drawing can be referenced and/or claimed in combination with any feature of any other drawing.

This written description uses examples for the disclosure, including the best mode, and also to enable any person skilled in the art to practice the disclosure, including making and using any devices or systems and performing any incorporated methods. The patentable scope of the disclosure is defined by the claims, and can include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A storage assembly for a consumer appliance, the storage assembly defining a vertical direction, a lateral direction, and a transverse direction, the vertical, lateral, and transverse directions being mutually perpendicular, the storage assembly comprising:

a mounting bracket;

a first mounting tab and a second mounting tab extending in the transverse direction from a first end of the mounting bracket, wherein the first mounting tab and the second mounting tab are configured to be inserted into a mounting track disposed within the consumer appliance;

a storage receptacle which is supported at a second end of the mounting bracket, wherein the storage receptacle comprises a rear plate including a rear surface;

a hinge pin attached to the mounting bracket;

a stop bar;

a return spring disposed between the stop bar and the mounting bracket; and a stop nodule affixed to the rear plate.

2. The storage assembly of claim 1, wherein the storage receptacle further comprises:

a cavity frame including a bottom portion attached to the rear plate, said bottom portion extending from the rear plate to a front portion of cavity frame in the transverse direction, wherein said bottom portion has a downward slope toward or away from the rear plate.

3. The storage assembly of claim 2, further comprising a hinge collar attached to the rear surface of the rear plate.

4. The storage assembly of claim 3, wherein the hinge pin is disposed within the hinge collar such that hinge collar can rotate about an axis extending in the transverse direction through a center of the hinge pin.

5. The storage assembly of claim 3, wherein the hinge collar can rotate about the axis extending through a center of the hinge pin in a clockwise direction to an angle of 35 degrees.

6. A storage assembly for a consumer appliance, the storage assembly defining a vertical direction, a lateral direction, and a transverse direction, the vertical, lateral, and transverse directions being mutually perpendicular, the storage assembly comprising:

a mounting bracket;

a first mounting tab and a second mounting tab extending in the transverse direction from a first end of the mounting bracket, wherein the first mounting tab and the second mounting tab are configured to be inserted into a mounting track disposed within the consumer appliance; and a storage receptacle which is supported at a second end of the mounting bracket, wherein the storage receptacle further comprises a cavity frame including a bottom portion attached to a rear plate, said bottom portion extending from the rear plate to a front portion of cavity frame in the transverse direction, wherein said bottom portion has a downward slope toward or away from rear plate;

a bracket base attached to the mounting bracket;

a hinge pin attached to the bracket base, wherein the hinge pin is disposed within the hinge collar such that hinge collar can rotate about an axis extending through a center of hinge pin in the vertical direction;

a hinge collar attached to a rear surface of the rear plate; and a latch mechanism which selectively engages, at least one of, the rear plate, the hinge pin, and the hinge collar to prevent hinge collar from rotating relative to hinge pin.

7. The storage assembly of claim 6, wherein the hinge collar can rotate about the axis extending through a center of hinge pin in a right direction to an angle of 90 degrees from a centerline and rotate in a left direction to an angle of 90 degrees from the centerline.

8. The storage assembly of claim 7, wherein the latch mechanism comprises a plurality of magnets attached to mounting bracket.

9. The storage assembly of claim 8, wherein the latch mechanism comprises a locking pin which engages the hinge pin and the hinge collar to prevent hinge collar from rotating relative to hinge pin.

10. A storage assembly for a consumer appliance, the storage assembly defining a vertical direction, a lateral direction, and a transverse direction, the vertical, lateral, and transverse directions being mutually perpendicular, the storage assembly comprising:

a mounting bracket;

a first mounting tab and a second mounting tab extending in the transverse direction from a first end of the mounting bracket, wherein the first mounting tab and the second mounting tab are configured to be inserted into a mounting track disposed within the consumer appliance; and a storage receptacle which is supported at a second end of the mounting bracket, wherein the storage receptacle further comprises a cavity frame including a bottom portion attached to a rear plate, said bottom portion extending from the rear plate to a front portion of cavity frame in the transverse direction, wherein said bottom portion has a downward slope toward or away from rear plate;

a bracket base attached to the mounting bracket; a hinge pin attached to the bracket base;

a mounting arm including a track protrusion;

a hinge collar attached to the mounting arm; and a track assembly, wherein the track assembly includes a receiving track attached to the storage receptacle, said receiving track configured to accept the track protrusion within a receiving slot;

a guide member; and a plunger assembly attached to the guide member, wherein a least of portion of plunger assembly is configured to be accepted within a void situated within the receiving track.

11. The storage assembly of claim 10, wherein the plunger assembly further comprises:

a spring;

a retention bracket; and a plunger including a flange and a pin, wherein at least a portion of the pin is configured to pass through the guide member into the void situated within the receiving track.

12. The storage assembly of claim 11, wherein the void within the receiving track comprises a holding surface and a contact ramp.

* * * * *